United States Patent [19]

Talacko

[11] Patent Number: 4,747,546

[45] Date of Patent: May 31, 1988

[54] SPRAY APPARATUS FOR ELECTROSTATIC POWDER COATING

[75] Inventor: Radovan Talacko, St. Gallen, Switzerland

[73] Assignee: Ransburg-Gema AG, Switzerland

[21] Appl. No.: 897,494

[22] Filed: Aug. 15, 1986

[30] Foreign Application Priority Data

Aug. 20, 1985 [DE] Fed. Rep. of Germany ..... 3529703

[51] Int. Cl.[4] ..... B05B 5/00

[52] U.S. Cl. ..... 239/707; 239/704; 239/391

[58] Field of Search ..... 239/706, 707, 704, 697, 239/698, 390, 391, 397

[56] References Cited

U.S. PATENT DOCUMENTS

| | | | |
|---|---|---|---|
| 3,195,819 | 7/1965 | Watanabe | 239/707 |
| 3,263,127 | 7/1966 | Point et al. | 239/707 |
| 3,698,635 | 10/1972 | Sickles | 239/706 |
| 4,266,721 | 5/1981 | Sickles | 239/707 |
| 4,417,696 | 11/1983 | Kako et al. | 239/690 |
| 4,548,363 | 10/1985 | McDonough | 239/707 |

FOREIGN PATENT DOCUMENTS

| | | | |
|---|---|---|---|
| 2402209 | 7/1975 | Fed. Rep. of Germany | 239/707 |
| 2347491 | 5/1979 | Fed. Rep. of Germany . | |
| 2851006 | 6/1979 | Fed. Rep. of Germany . | |
| 3447338 | 8/1985 | Fed. Rep. of Germany . | |
| 1223451 | 6/1960 | France | 239/707 |
| 0225921 | 8/1985 | German Democratic Rep. . | |
| 1038865 | 8/1966 | United Kingdom | 239/706 |

OTHER PUBLICATIONS

"Journal of Electrostatics", 16 (1985), p. 283.

"Das Elektrostatische Pulverbeschichten in Entwicklung und Anwendung", 1983/84, pp. 39–43, Fachbroschüre Oberflachentechnik.

"Elektrostatisches Beschichten", 25 Jun. 1975, pp. 27–37.

*Primary Examiner*—Kenneth J. Dorner

*Assistant Examiner*—Gerald A. Anderson

*Attorney, Agent, or Firm*—Ostrolenk, Faber, Gerb & Soffen

[57] ABSTRACT

A versatile spraying gun includes main tool and several attachment tools any one of which can be inserted in the main tool. Each attachment tool is designed to atomize powder particles that are to be sprayed on an article in accordance with a specific spraying method and atomization principle and method. The main common tool is comprised primarily of a body that defines a powder delivery channel and a coupling piece and discharge electrode located upstream in the delivery channel. The attachment tools have a flow guide member disposed axially within the delivery channel and an attachment piece for attaching the attachment tool to the coupling piece of the main tool. In some attachment tools, the flow guide member also houses a high voltage circuit and appropriate electrodes needed for electrostatic charging of the powder which passes through an electrical field set up between the electrodes.

19 Claims, 2 Drawing Sheets

SPRAY APPARATUS FOR ELECTROSTATIC POWDER COATING

BACKGROUND OF THE INVENTION

The present invention relates to a spray apparatus for electrostatic powder coating and, more particularly to a spray gun having a main tool which is adapted to be used with several different attachment pieces, each operating on a different spraying principle.

The main tool has a powder delivery channel, a mouth on the downstream end of the delivery channel effective for atomizing the powder, a powder feed line for feeding pneumatically conveyed powder into the initial upstream section of the delivery channel, and a gas feed line through which gas is guided into the delivery channel along a discharge electrode which can be connected to ground potential.

A spray apparatus of the above type is known from Federal Republic of Germany Pat. No. 23 47 491. The wall of the delivery channel is constructed of electrically insulating material against which particles of powder rub to thereby become electrically charged. In the process, however, electric charges collect on the channel wall and these charges impede the process of electrically charging the powder particles. To solve the problem, a discharge electrode extends within the delivery channel into the powder/gas stream and serves to remove the accumulated charge from the channel wall via the discharge electrode to a ground potential. The gas in the gas feed line flows over the discharge electrode to assure that powder particles do not attach themselves to the electrode.

A similar apparatus is also described in Federal Republic of Germany Pat. No. 22 03 351. Moreover, German Democratic Republic Pat. No. 134 841 also describes a spray apparatus of the above type in which a flow guide member of electrically insulating material is arranged within the delivery channel causing the powder to charge electrically by rubbing both on the channel wall and on the surface of the flow guide member.

Federal Republic of Germany OS No. 27 56 009 (corresponding to U.S. Pat. No. 4 090 666) describes a spray apparatus that does not have a discharge electrode. Gas is introduced into the delivery channel, via a gas feed line that extends coaxially to the powder/gas stream of the pneumatically conveyed powder in a manner that is effective for driving the particles of powder together with the gas in the gas feed line radially outward and against the wall of the channel. As a result, more particles of powder rub along the wall of the channel with stronger frictional pressure. The powder as a whole is therefore more strongly charged There are also other spray devices in which the powder is electrically charged by high voltage electrodes which are located in the flow path of the powder and which are connected to a high-voltage terminal of a high-voltage generator circuit. In this type of spray gun, a distinction is made between so-called "internal charging", in which the electrode is located upstream from the place where the atomization of the powder begins, and so-called "external charging," in which the electrode is located in a region where the powder is being atomized or has already been atomized. "Atomization" refers to the process whereby the powder particles of the stream of powder are driven radially apart.

Such an apparatus is shown, for example, in Federal Republic of Germany Pat. No. 20 30 388.

SUMMARY OF THE INVENTION

The present invention is directed at a versatile spray gun which can electrostatically charge the powder according to several different charging methods and be switched from one method to another by a simple manipulation. The change is effected rapidly by attachment substitutions. The spray gun has a simple and inexpensive construction.

In accordance with the invention, the spray gun is constructed as a variable tool set with at least two alternatively usable attachment tools, each of which is based on a unique method of electrostatic powder charging. A main common tool forms an initial upstream section of a delivery channel and has a coupling end or piece to which an attachment member of a respective one of the attachment tools is secured.

Each attachment tool is basically a flow guide member, part of which forms the attachment member that is used for attaching the attachment tool to the main tool. In an attached state, the guide member extends axially through the delivery channel of the main tool and has such a shape that an annular flow channel for the powder is formed between the guide member and the inner wall surface of the delivery channel.

In friction based attachment tools the guide member has, at least on its cylindrical surface which forms the inner channel wall, an electrically insulating material for the electrokinetic charging of the powder through rubbing of the powder along the material. In another type of attachment tool, a high voltage generator circuit is arranged in the flow guide member and at least one electrode attached to said the voltage generator circuit is also provided for electrostatic charging of the powder.

As described above, a spraying gun tool kit is provided in which one of several different attachment tools can be alternatively inserted in the main tool so that the main tool can be adapted at the option of the user to different electrostatic spray coating methods.

Other features and advantages of the present invention will become clear from the following description of the invention which is set forth by referring to the following drawings.

DETAILED DESCRIPTION OF THE DRAWINGS

Figure 1:
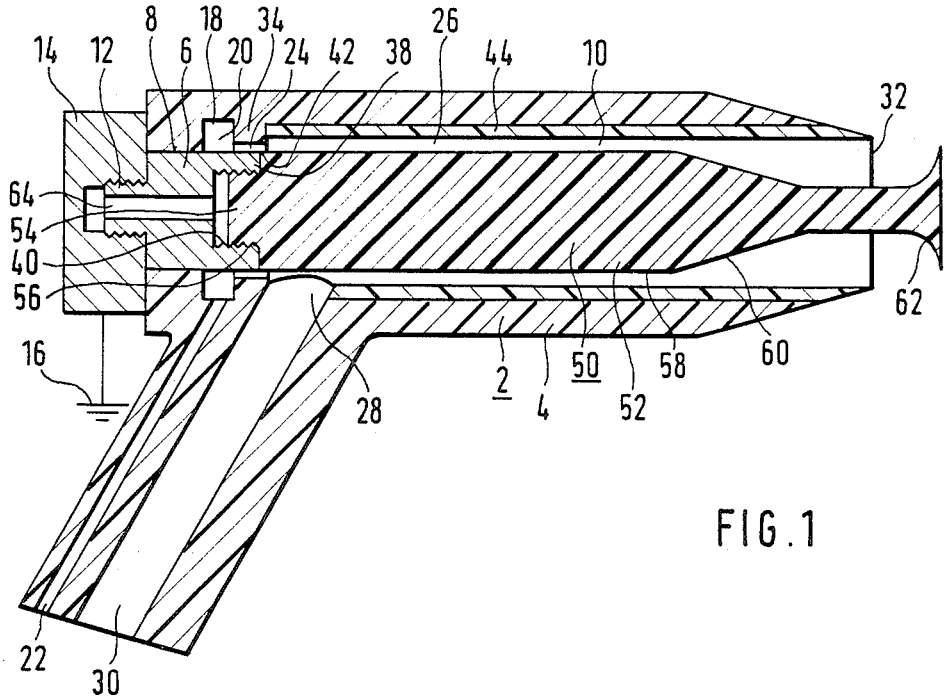
FIG. 1 is a longitudinal section through a first embodiment of a spray apparatus of the present invention.

In each of the embodiments of the present invention main tool 2 of the spray apparatus has a pistol shaped housing 4 constructed of electrically insulating material and an electrically conductive discharge electrode 6. Discharge electrode 6 is connected to pistol body 4 within a channel part 8. Channel part 8 is an extension of a delivery channel 10 which is formed in pistol body 4. An end section 12 of discharge electrode 6 extends out at the rear of pistol body 4 and is connected to a ground-potential attachment 16 by a nut 14 screwed thereon.

Another part 18 of delivery channel 10 defines an annular groove which forms an annular space 20 that surrounds discharge electrode 6. A gas feed line 22 passes through pistol body 4 to communicate into annular space 20. Annular space 20 communicates, via a flow choke 24, to a channel 26 located in delivery channel 10. Channel 26 extends from mouth 28 of powder feed line 30 formed in pistol body 4 to a mouth 32 located at the downstream end of delivery channel 10. The flow choke 24 is annular slot shaped and is bounded on the outside by wall part 34 of delivery channel 10 and on the inside, over a portion of its length, by a downstream end section 12 of discharge electrode 6.

End section 12 of the discharge electrode 6 is shaped as a coupling piece with internal threads 40 that enable an attachment tool to be screwed thereinto. Part of the inner wall of the annular slot which forms flow choke 24 is formed at the downstream end section 42, by a portion of the attachment tool which is screwed into internal threads 40 of discharge electrode 6. Channel 26 defined in the delivery channel 10 through which the powder flows has a channel wall 44 constructed of electrically insulating material which is effective for electrically charging by friction particles of powder which rub therealong.

For the spray apparatus of FIG. 1 there is provided an attachment tool 50 which includes a flow guide member 52 with an attachment piece 54. The attachment piece 54 is provided with threads 56 and it is screwed into internal threads 40 of discharge electrode 6. Flow guide member 52 is thereby secured axially within channel 26 of delivery channel 10. Flow guide member 52 is constructed of an electrically insulating material which electrically charges by friction particles of powder which rub therealong. Cylindrical wall 58 forms an inner channel wall for channel 26 that gives it its annular cross section form that is defined between inner channel wall 58 and outer channel wall 44.

Flow guide member 52 is provided, upstream of mouth 32, with a body section which tapers conically in the flow direction and which enlarges the annular space of channel 26 in the flow direction. Diffusion-like atomization of the powder is thereby carried out along body section 60 before the powder leaves mouth 32 to be further atomized by impingement on baffle plate 62. Baffle plate 62 is the specially shaped free end part of flow guide member 52.

The powder particles in channel 26 are electrostatically charged by friction both by outer channel wall 44 and by inner channel wall 58. The powder is fed pneumatically via feed line 30 and the gas is added to the stream of powder as soon as it emerges from feed line 30.

An axially extending hole 64 is formed through discharge electrode 6 which hole 64 serves for facilitating usage with various attachment tools described below with reference to FIGS. 2, 3 and 4. All embodiments described below use the same main tool 2 described above but with different attachment tools. Only those parts which differ from the first described embodiment of FIG. 1 will be specifically mentioned.

Figure 2:
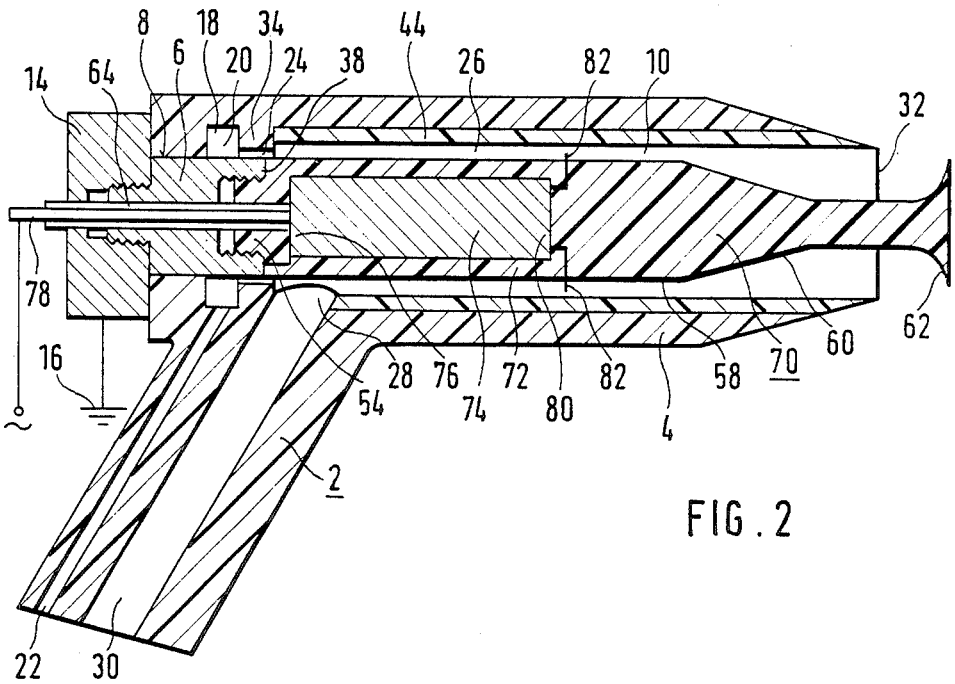
FIG. 2 is a longitudinal section through a second embodiment of the spray apparatus of the present invention.

FIG. 2 depicts an attachment tool 70 having a flow guide member 72 and a high voltage generator circuit 74 arranged within flow guide 72. High voltage generator circuit 74 has, on a low-voltage side 76 thereof, a power supply cable 78 which passes through bore 64 of discharge electrode 6. A high-voltage side 80 of high-voltage generator circuit 74 is connected to electrodes 82 which extend, downstream of tapered body section 60, into channel 26. Electrodes 82 electrostatically charge powder which flows through the high electrical field that is created between electrodes 82.

In the foregoing arrangement, the term "internal charging" is used to indicate that the charging of powder takes place before expansion of the powder along body section 60. Flow guide member 72 and baffle plate 62 are formed of a plastic part within which the high voltage generator circuit 74 and electrodes 82 are enclosed. In the second embodiment of FIG. 2, the powder is also electrically charged by friction, by rubbing against inner channel wall 58 and outer channel wall 44.

Figure 3:
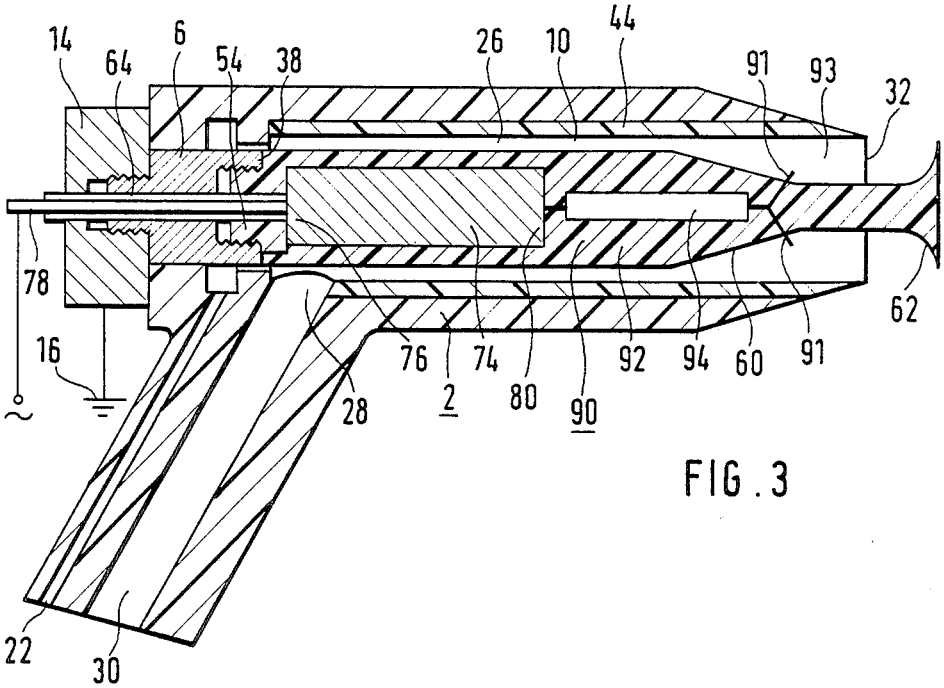
FIG. 3 is a longitudinal section through a third embodiment of the spray apparatus of the present invention.

FIG. 3 illustrates a third embodiment which includes an attachment tool 90 similar to that of the second embodiment of FIG. 2. However in the third embodiment electrodes 91 of a current lead member 92 are arranged in a region 93 upstream of mouth 32, a location at which the powder has already been partially atomized by the tapered body section 60 of the flow guide member 92. In such an embodiment the term "external charging" is used to refer to the foregoing feature. Electrodes 91 are connected via an electric protective resistor 94 to the high-voltage side 80 of a high-voltage generator circuit 74 which is enclosed in flow guide member 92, which is preferably formed of plastic.

Figure 4:
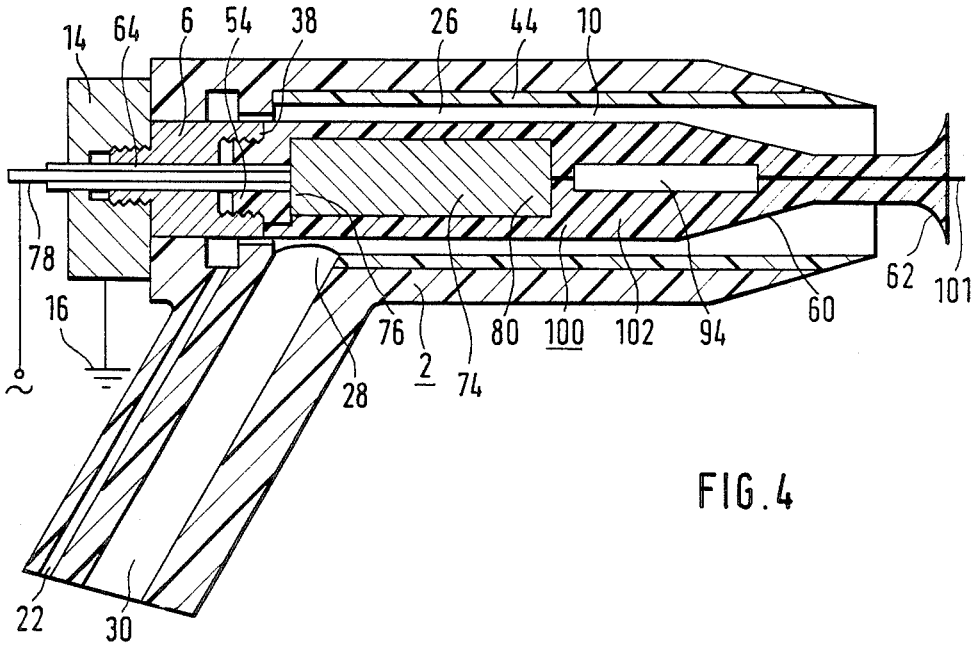
FIG. 4 is a longitudinal section through a fourth embodiment according to the present invention.

A fourth embodiment of the invention appears in FIG. 4. An attachment tool 100 has an electrode 101 extending out of the front end of baffle plate 62. Electrode 102 is connected via electric protective resistor 94 to the high-voltage side 80 of high-voltage generator circuit 74 which is encased in flow guide member 102. Flow guide member 102 is constructed of electrically insulating plastic material which electrically charges, by friction, the powder particles which rub therealong.

Electric protective resistor 94 is also enclosed within flow guide members 32 of FIG. 3 and 102 of FIG. 4. In the first embodiment, shown in FIG. 1, electrostatic charging of the powder is entirely by friction. In the second to fourth embodiments shown, respectively, in FIGS. 2, 3 and 4, electrostatic charging is also obtained by means of electrodes 82, 91, 101.

In all embodiments, the attachment tool 50, 70, 90 or 100 is comprised primarily of a flow guide member in which all parts or materials necessary for the electrostatic charging of the powder are integrated. Therefore, the attachment tool can be rapidly replaced since all that is needed is to screw a different flow guide member into the main tool. The single main tool 2 described above is common to all the embodiments. The main tool 2 has a single coupling piece 38 which is but a part of main tool 2 and which preferably also constitutes the discharge electrode 6 for the invention.

As a variation, it is also possible for channel part 8 of the delivery channel 10 to be formed as the attachment piece for the attachment tool which would then have threads, for interconnection purposes. In such a case, discharge electrode 6 would be an undetachable part of flow guide member 52. Also in such case, attachment tools 70, 90 and 100 of FIGS. 2, 3 and 4 would have to have an attachment piece which is shaped to conform to discharge electrode 6, attached to flow guide member 72, 92, 102 and which can be inserted together with it in detachable manner into part 8, preferably to be screwed therein.

For attachment tools 70, 90 and 100 of FIGS. 2, 3 and 4 good results are obtained even if the powder is charged solely electrically by electrodes 82, 19, 101, even without frictional charging. Where friction based charging is not used discharge electrode 6 may be omitted. Attachment piece 38 is sufficient and adequate for handling attachment tools 70, 90 and 100. From an overall perspective, this attachment piece can have the shape of discharge electrode 6 and consist of electrically nonconductive or conductive material.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spraying apparatus for spraying electrically charged powdered material, the apparatus comprising:

a main tool which is operable with any one of a plurality of different attachment tools; the main tool including a body; a powder delivery channel defined in the body along an axial direction therein, the delivery channel having an upstream end region starting at an initial section and having a downstream end region terminating in a downstream end; a mouth located at the downstream end of the delivery channel; a powder feed line for feeding powder to the initial section in the upstream region in the delivery channel; a gas feed line for supplying a gas into the delivery channel at the upstream end region thereof; and a coupling piece disposed at the upstream region of the apparatus and accessible to the delivery channel, the coupling piece having a shape and means for securing any selected one of a plurality of different attachment tools that is introduced into the delivery channel through the mouth thereof to the coupling piece, whereby the main tool serves as a common tool for use with the attachment tools;

a discharge electrode located in the delivery channel at the upstream end region thereof and means for connecting the discharge electrode to an electrical potential of predetermined value;

the gas feed line being located upstream in relation to the powder feed line in a configuration which is effective for blowing the gas over the discharge electrode to keep the powder away from the discharge electrode.

2. The apparatus of claim 1 wherein at least a portion of an inner surface of the main tool in the delivery channel is comprised of electrically insulative material which is effective for electrokinetically charging the powdered material.

3. The apparatus of claim 1 in which the discharge electrode comprises a passageway and electrical wire means passing through the passageway, the electrical wire means being located to electrically mate with an attachment tool that employs a high voltage circuit for charging the powder.

4. The apparatus of claim 1 in which the coupling piece is integrally formed in the discharge electrode.

5. The apparatus of claim 4 in which the coupling piece comprises a threaded recess in the discharge electrode for receiving a threaded attachment member of the attachment tool therein.

6. The apparatus of claim 1 further comprising an annular slot formed between the body and the discharge electrode, the gas feed line communicating into the annular slot.

7. The apparatus of claim 6 which further comprises a flow choke passageway in communication with the annular slot and downstream thereof for coupling gas from the annular slot into the delivery channel.

8. The apparatus of claim 7 wherein the flow choke is annularly shaped and is defined by a first annular surface located on the body of the main tool and by a second annular surface defined partially by the discharge electrode and partially by the attachment tool that is to be secured in the delivery channel.

9. The apparatus of claim 1 wherein the coupling piece comprises a channel part located upstream in the delivery channel and containing threads formed on an inner surface thereof to which the selected one of the attachment tools having threads formed thereon may be screwed thereinto.

10. A spraying apparatus kit for spraying electrically charged powdered material, the apparatus comprising:

a main tool including a body; a powder delivery channel defined in the body along an axial direction therein, the delivery channel having an upstream end region starting at an initial section and having a downstream end region terminating in a downstream end; a mouth located at the downstream end of the delivery channel; a powder feed line for feeding powder to the initial section in the upstream region in the delivery channel; a gas feed line for supplying a gas into the delivery channel at the upstream region thereof;

a plurality of different attachment tools, each one of the attachment tools including an elongate flow guide member that can be inserted through the mouth into the delivery channel of the main tool, the flow guide member having a longitudinal cross-section which is smaller than a longitudinal cross-section in the delivery channel for defining an annular channel bounded between the guide member and an inner surface of the body in the delivery channel, the respective guide member in each of the attachment tools being shaped for charging and atomizing the powder material in accordance with a unique charging method, each of the attachment tools further including an attachment piece; and a coupling piece disposed at the upstream region of the apparatus and accessible to the delivery channel, the coupling piece having a shape and means for securing thereto the attachment piece of any selected one of the plurality of different attachment tools, whereby the main tool serve as a common tool for use with attachment tools and is operative for spraying and electrostatically charging the powdered material in accordance with a plurality of different spraying and charging methods.

11. The apparatus of claim 10 which further comprises a discharge electrode located in the body at the upstream region thereof and means for connecting the discharge electrode to an electrical potential of predetermined value.

12. The apparatus of claim 11 wherein at least a portion of the inner surface of the main tool and a facing peripheral surface of the guide member of at least one of the attachment tools is comprised of electrically insulative material which is effective for electrokinetically charging the powdered material.

13. The apparatus of claim 12 in which at least one of the attachment tools includes a high-voltage generator circuit located in its respective flow guide member and at least one electrode located on the guide member and coupled to the high-voltage generator for electrostatically charging the powder with a high electrical field.

14. The apparatus of claim 13 in which the least one electrode is located downstream of a region in the delivery channel wherein atomization of the powdered material begins.

15. The apparatus of claim 13 in which the at least one electrode is located within a region in the delivery channel wherein atomization of the powdered material is carried out.

16. An apparatus as in claim 13 in which the attachment piece of the at least one of the attachment tools which includes the high-voltage generator circuit also includes a passageway and wire means passing through the passageway for supplying electrical power to the high-voltage generator circuit located therein.

17. The apparatus of claim 11 in which the coupling piece in the main tool is integrally formed in the discharge electrode.

18. The apparatus of claim 11 in which the gas feed line is located downstream in relation to the powder feed line in a configuration which is effective for blowing the gas over the discharge electrode to keep the powder away from the discharge electrode.

19. The apparatus of claim 13 further comprising an annular slot formed between the body and the discharge electrode, the gas feed line communicating into the annular slot and further comprising a flow choke passageway in communication with the annular slot and downstream thereof for coupling gas from the annular slot into the delivery channel, whereby electrical charges collected on the insulated material of the main tool and the flow guide are capable of flowing through the gas to the discharge electrode to be discharged therefrom.

* * * * *